US005635664A

United States Patent [19]

Pons et al.

[11] Patent Number: 5,635,664

[45] Date of Patent: Jun. 3, 1997

[54] FUNCTIONING MECHANISM FOR A SMALL CALIBRE AUTOMATIC WEAPON

[75] Inventors: René Pons, Saint Etienne; Jean-Pierre Montgrenier, Veauche, both of France

[73] Assignee: Giat Industries, Versailles, France

[21] Appl. No.: 421,877

[22] Filed: Apr. 14, 1995

[30] Foreign Application Priority Data

Apr. 28, 1994 [FR] France ..... 94 05154

[51] Int. Cl.[6] ..... F41A 19/44

[52] U.S. Cl. ..... 89/149; 89/144; 89/151; 89/154; 42/69.03

[58] Field of Search ..... 89/132, 149, 150, 89/151, 152, 154, 144; 42/69.03

[56] References Cited

U.S. PATENT DOCUMENTS

| | | | |
|---|---|---|---|
| 929,286 | 7/1909 | Clarus | 89/144 |
| 1,052,394 | 2/1913 | White | 89/144 |
| 2,139,203 | 12/1938 | Petter | 89/144 |
| 2,371,012 | 3/1945 | Woodhull | 89/149 |
| 3,626,805 | 12/1971 | Shiplee, III | 89/128 |
| 4,361,072 | 11/1982 | Karlsen | 89/154 |
| 4,522,105 | 6/1985 | Atchisson | 89/139 |
| 5,339,721 | 8/1994 | Beretta | 89/142 |

FOREIGN PATENT DOCUMENTS

| | | |
|---|---|---|
| 1235856 | 5/1960 | France . |
| 213109 | 9/1909 | Germany . |
| 739126 | 11/1943 | Germany . |

*Primary Examiner*—Michael J. Carone
*Assistant Examiner*—Christopher K. Montgomery
*Attorney, Agent, or Firm*—Oliff & Berridge

[57] ABSTRACT

A functioning mechanism for a small caliber automatic weapon includes a translatable and rotatable sear, and a rotatable hammer. The sear includes a hooking element adapted to contact a bearing surface of the hammer to render the hammer immobile. Rotating movement of the sear is controlled by the hammer in such a way as to obtain clean contact between the hooking element and the bearing surface.

17 Claims, 2 Drawing Sheets

FUNCTIONING MECHANISM FOR A SMALL CALIBRE AUTOMATIC WEAPON

BACKGROUND OF THE INVENTION

The subject of the invention is that of a functioning mechanism for a small caliber automatic weapon. The mechanism comprises a sear that moves from its starting position to its firing control position under the action of a rotating trigger, and a hammer having a rotating movement alternating between a cocked position and a striking position during the firing of a burst of rounds. The sear comprises a hooking element designed to come into contact with a bearing surface of the hammer in order to render the hammer immobile when the sear is in its starting position before firing the first round of the burst and when the sear has returned to its starting position after firing the last round of the burst.

One of the problems associated with this type of mechanism is the risk of silvering of the sear hooking element and/or of the hammer bearing surface, which cooperate with one another to ensure the immobility of the hammer. In fact, as the sear and the hammer are both moving at the same time, one must catch up with the other, such that the hooking element and the bearing surface often move over one another before coming into contact with one another. In other words, the hammer is not brought to a dead stop by the sear.

The silvering of the sear hooking element and/or the hammer bearing surface causes wear such that the safety of the weapon is likely to be endangered. One solution to this problem may consist in subjecting these parts to heat treatment, but that would increase their manufacturing cost.

SUMMARY OF THE INVENTION

An aim of the invention is to devise a mechanism which is able to make up for the inconveniences described hereabove, while procuring other advantages.

To this end, the invention proposes a mechanism of the type described above that includes a sear that is both mobile in translation and in rotation, and that, when moving forward to its firing control position, is mobile in translation in order to make the hammer rotate towards its cocked position, and then is mobile in rotation from a low position to a high position in order to free the hammer. The sear, moving back to its starting position, is mobile in translation, then mobile in rotation from its high position to its low position in order to bring the hooking element into the trajectory of the hammer bearing surface so as to render the hammer immobile. The rotational movement of the sear, having returned to its starting position, is controlled by the rotating movement of the hammer.

Thus, the sear is positioned by the hammer itself in its own trajectory in such a way that the hammer bearing surface comes into clean contact with the sear hooking element in order to immobilize the hammer.

According to another aspect of the invention, the hammer bearing surface which cooperates with the sear hooking element in order to immobilize the hammer may also form a control element to rotate the sear from its low position to its high position.

According to yet another aspect of the invention, the hammer may comprise a second bearing surface which forms a control element in order to make the sear rotate from its high position to its low position, by coming into contact with the bearing surface of the sear.

The two bearing surfaces may, with advantage, be constituted from the two opposite surfaces of a boss integral with the hammer.

In this type of weapon, the hammer is mounted rotating around a fixed shaft on the weapon, this shaft being positioned to one end of the hammer, whereas the other end of the hammer forms a firing pin. According to another aspect of the invention, the boss may be located between the firing pin and the support shaft of the hammer, the boss comprising one side formed by a curved surface wherein the curve radius is centered on the hammer support shaft, and the two lateral sides of this boss, which are defined by the curved side, respectively, form the two bearing surfaces of the hammer which cooperate with the sear.

According to another aspect of the invention, the sear may comprise a U-shaped part having two lateral wings which lie roughly along the same plane, parallel to one another and joined together by a central part. The hooking element may be made from an inner rim designed on the edge of one of the sear wings. The inner surface edge of the other wing of the sear forms a bearing surface designed to cooperate with one of the two above-mentioned bearing surfaces of the hammer in order to make the sear rotate from its high position to its low position.

Generally, the sear and the hammer may be mounted along two parallel planes, the hammer boss being positioned between the two faces opposite the sear and the hammer.

According to another aspect of the invention, the sear may be mounted rotating around a shaft supported by a small bar which is mobile in translation, the bar itself being linked to the weapon trigger using a joint.

According to one important advantage of the weapon, the mechanism operates safely and avoids undue wear of the sear and of the hammer along the areas which come into contact with each other when the hammer is rendered immobile by the sear.

BRIEF DESCRIPTION OF THE DRAWINGS

Other advantages, characteristics and details of the invention will become apparent after reading the description hereafter which is made in reference to the appended drawings which are given by way of illustration and wherein.

DETAILED DESCRIPTION OF PREFERRED EMBODIMENTS

Figure 1:
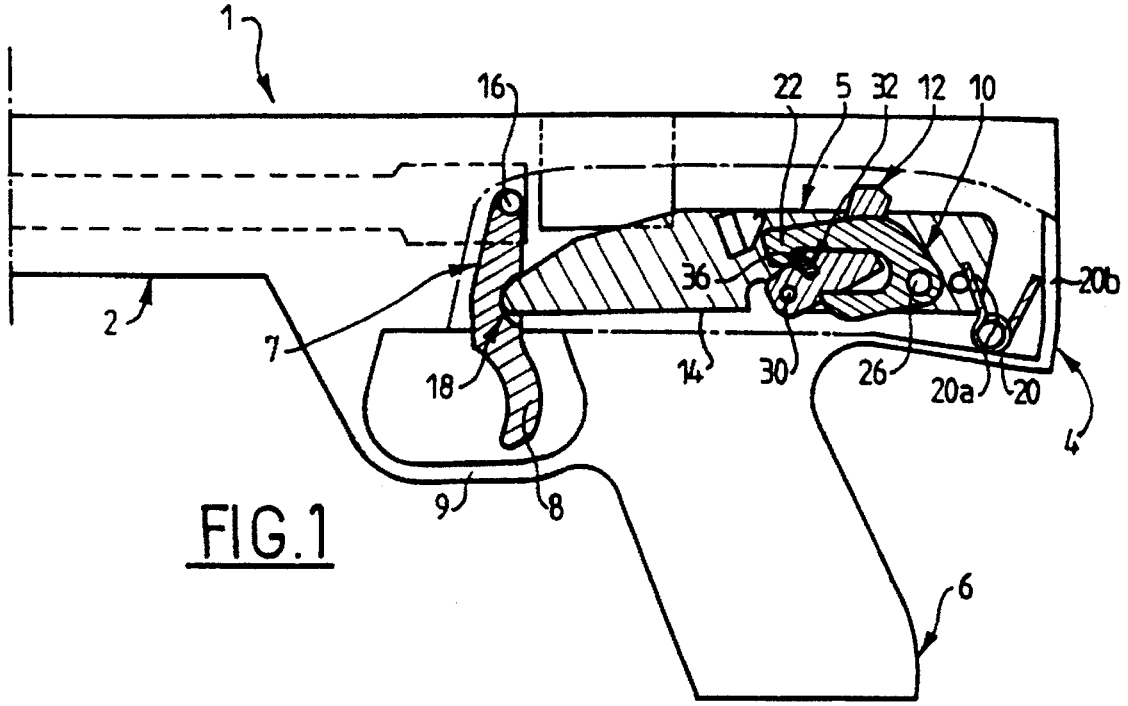
FIG. 1 is a skeleton view, partially truncated, of a small caliber automatic weapon fitted with a mechanism according to the invention.

The weapon 1, such as shown in FIG. 1, comprises a barrel assembly 2, a butt 4 which houses the operating mechanism 5 of the weapon, a grip 6, and a rotating trigger 7 linked to the mechanism 5 and comprising a fingerpiece protected by a trigger guard 9.

The mechanism 5 comprises a sear 10 corresponding with a hammer 12, a small bar 14 which is mobile in translation and which ensures a mechanical link between the trigger 7 and the sear 10. The trigger 7 is rotatably mounted about a fixed axis 16 supported by the body of the weapon. One end of the bar 14 is linked at point 18, in a jointed manner, to the trigger 7, whereas its other end cooperates with a return spring 20 which tends to automatically bring the trigger 7 back to its starting position when the trigger finger-piece 8 is released. The joint 18 between the bar 14 and the trigger 7 is, for example, made from a ball joint, and the return spring 20 for example bears, on one end, on a peg 20*a* integral with the bar 14 and, on the other, on the fixed inner wall 20*b* of the butt 4.

Figure 2:
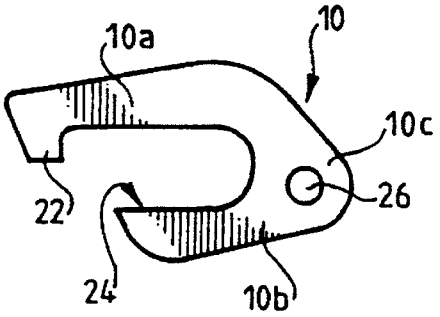
FIG. 2 shows the sear of the mechanism according to the invention.

Referring to FIG. 2, the sear 10 is made from a U-shaped part having two wings 10*a* and 10*b* lying along roughly the same plane, parallel to one another and joined together by a central part 10*c*. The wing 10*a* extends over a length greater than that of the wing 10*b*, and the wing 10*a* has a free end including an inner rim which forms a hooking element 22. The end of the inner face of wing 10*b* forms a bearing surface 24, the function of which will be explained later. The sear 10 is rotatably mounted, in its central part 10*c*, around an axis constituted by a shaft 26 which is perpendicular to the plane of the sear 10 and which is supported by the linking bar 14 (see FIG. 1).

Figure 3:
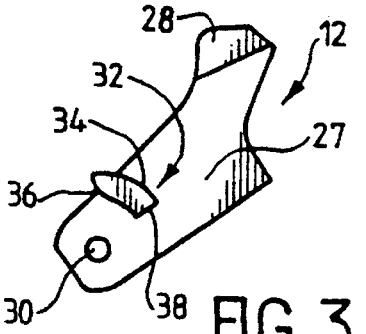
FIG. 3 shows the hammer of the mechanism according to the invention.

Referring to FIG. 3, the hammer 12 has two main faces 27 which are opposite each other with, on one end, a firing pin 28, whereas the other end is mounted rotating around an axis represented by a fixed shaft 30 supported by the body of the weapon (FIG. 1) and parallel to the shaft 26 around which the sear 10 rotates. The hammer 12 has a boss 32 on one of its faces 27 near to the shaft 30. One side 34 of the boss 32 is formed from a curved surface wherein the radius of the curve is centered on the shaft 30, whereas the two lateral sides which are conditioned by this curved side 34 respectively form two contact surfaces 36 and 38.

Referring once again to FIG. 1, the sear 10 and the hammer 12 are mounted along two parallel planes, these two planes being parallel to the plane of symmetry of the weapon along the line of the barrel assembly 2 and the main face 27 of the hammer 12 supporting the boss 32 which lies opposite the face adjacent to the sear 10.

Referring to FIGS. 4 to 7, the functioning principles of the mechanism 5 will hereafter be described.

Generally, the sear 10 is mobile in translation between a starting position and a firing control position. When the sear 10 is in its firing control position, it is apt to rotate around the shaft 26 between two positions, low and high, respectively. The translational movement of the sear 10 is controlled by the trigger 7 and via the linking bar 14, whereas the rotating movement of the sear 10 is controlled by the hammer 12.

Figure 4:
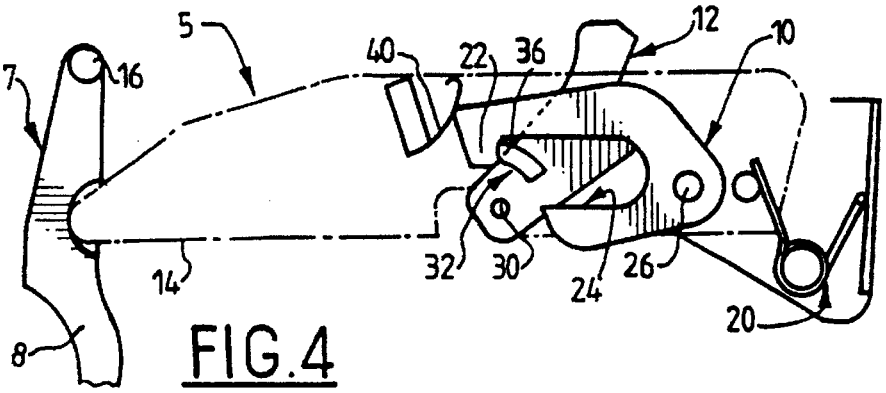
FIGS. 4 to 7 illustrate, using skeleton diagrams, the operation of the mechanism according to the invention.

FIG. 4 shows the mechanism 5 in its starting position, that is to say when the trigger 7 is not subjected to any pressure.

The sear 10 is in its starting position, whereas the hammer 12 is in an intermediary position between the firing and cocked positions. The hammer is rendered immobile by the sear 10 whereof the hooking element 22 is in contact with the bearing surface 36 of the boss 32 of the hammer 12.

When the trigger 7 is activated, by means of the application of pressure from the marksman's finger, the trigger 7 rotates around its shaft 16 and causes the translational movement of the bar 14 and of the sear 10, which are integral with one another during rearward movement.

Figure 5:
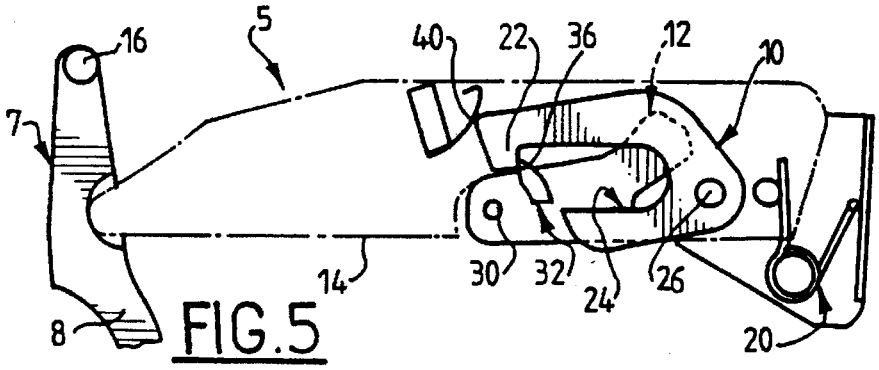
Figure 6:
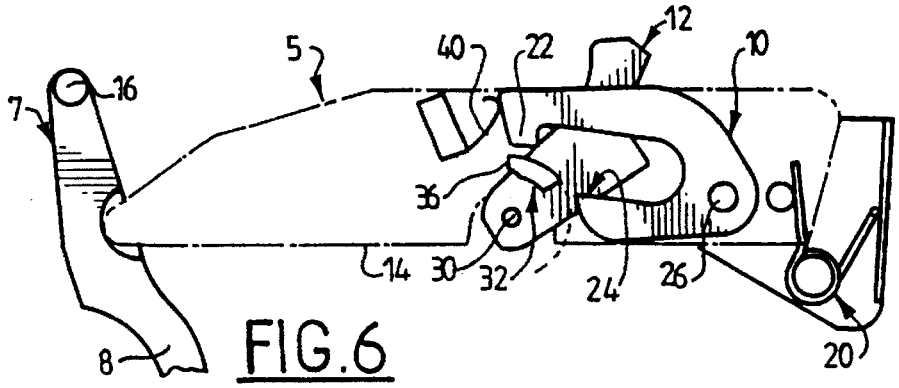

The mechanism 5 thereafter moves into the position shown in FIG. 5. The translational movement of the sear 10 forces the hammer 12 to rotate around its shaft 30 towards the cocked position. In fact, as it moves translationally, the hooking element 22 of the sear 10 remains in contact with the bearing surface 36 of the boss 32 of the hammer 12 thereby causing the hammer to rotate around its shaft 30.

Beyond a certain angle of rotation of the trigger 7, that is to say when the hammer 12 reaches its cocked position, the bearing surface 36 of the boss 32 of the hammer 12 slips out of the hooking element 22 of the sear 10. There are two consequences to this. The hammer 12 is freed and, under the action of a return spring (not shown), the hammer is pushed back towards its firing position. When the bearing surface 36 of the boss 32 slips out of the hooking element 22, the boss 32 imparts an impetus to the sear 10 which moves into its high position by rotating around its shaft 26. In fact, the bearing surface 24 of the sear 10 is located outside the trajectory of the curved side 34 of the boss 32 of the hammer 12 thereby enabling the sear 10 to rotate.

The hammer 12 is thereby totally disengaged from the sear 10 and may be given an alternative rotational movement under the action, on the one hand, of the release of a spring not shown) which is tensed when the hammer 12 moves from its cocked position to its firing position and, on the other hand, of the movement of the weapon breech after firing a round, in order to bring the hammer 12 back to its cocked position with the compression of the cocking spring. This back-and-forth movement of the hammer 12 enables a burst of rounds to be fired automatically so long as the marksman maintains the pressure on the finger-piece 8.

When the marksman releases the finger-piece 8, the finger-piece is automatically brought back to its starting position using the release of the return spring 20 which exercises a permanent action on the linking bar 14. This results in the translational movement of the bar 14 and the sear 10 which are integral with one another during this return movement.

Figure 7:
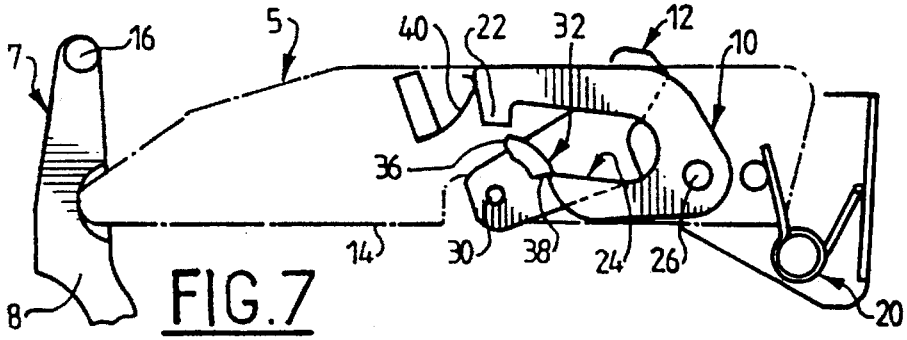

The mechanism 5 thereafter moves into the position shown in FIG. 7. The effect of the translational movement of the sear 10 is to position the hooking element 22 and the bearing surface 24 of the wing 10*b* of the sear 10 directly in the trajectory of the boss 32 of the hammer 12. The last round of the burst having been fired, and when the hammer 12 returns to its cocked position, the bearing surface 38 of the boss 32 of the hammer 12 comes into contact with the bearing surface 24 of the sear 10, and the sear returns to its low position when the hammer 12 reaches its cocked position.

The sear 10 is thereby positioned in such a way as to be able to render the hammer 12 immobile when it is pushed once again towards its firing position under the action of the cocking spring, that is to say, the hooking element 22 of the sear 10 is positioned so as to intercept the bearing surface 36 of the boss 32 of the hammer 12.

The mechanism 5 thereby returns to the position shown in FIG. 4, that is to say that the bearing surface 36 of the boss 32 of the hammer 12 is in contact with the hooking element 22 of the sear 10.

Finally, the presence of a spring-blade 40 to stabilize the sear 10 in its low and high positions may also be provided.

We claim:

1. A functioning mechanism for an automatic weapon comprising:

a rotatable trigger;

a sear that moves between a starting position and a firing control position as said rotatable trigger is actuated, said sear including a hooking element; and a hammer rotatable between a cocked position and a firing position during firing of said weapon, said hammer including a bearing surface that is adapted to electively contact the hooking element of the sear, wherein the sear exerts a rearward axial force to cause the hammer to rotate towards a cocked position when the sear moves to the firing control position, and wherein the sear rotates from a low position to a high position after the hammer reaches the cocked position.

2. A mechanism according to claim 1, wherein the bearing surface of the hammer that cooperates with the hooking element of the sear, also forms a control element to rotate the sear from its low position to its high position.

3. A mechanism according to claim 2, wherein the hammer comprises a second bearing surface that forms a control element to make the sear rotate from said high position to said low position, by coming into contact with a lower bearing surface of the sear.

4. A mechanism according to claim 3, wherein the two bearing surfaces of the hammer comprise the two opposite surfaces of a boss integral with the hammer.

5. A mechanism according to claim 4, wherein the hammer is rotatably mounted about a fixed shaft on the weapon, said fixed shaft being positioned to one end of the hammer, whereas another end of the hammer forms a firing pin, and further wherein the boss is located between the firing pin and the fixed shaft of the hammer, the boss comprising one side formed by a curved surface having a curve radius that is centered on the fixed shaft of the hammer, and two lateral sides of the boss, which are defined by the curved surface, respectively, forming the two bearing surfaces that control rotational movement of the sear.

6. A mechanism according to claim 5, wherein the sear is a U-shaped part having two lateral wings that lie roughly along a common plane, parallel to one another and joined together by a central part, and wherein the hooking element comprises an inner rim on an edge of one of the wings of the sear, an inner wall edge of another wing of the sear forming a bearing surface that cooperates with a second bearing surface of the hammer.

7. A mechanism according to claim 5, wherein the sear and the hammer are mounted along two parallel planes, the boss of the hammer being positioned on a face of the hammer defining one plane toward the plane defined by the sear.

8. A mechanism according to claim 1 wherein the sear is integral in translation movement with a bar linked to the trigger of the weapon.

9. A mechanism according to claim 1, wherein as the sear is translated back to the starting position, the sear rotates from the high position to the low position to bring the hooking element into a trajectory of the bearing surface of the hammer so as to render the hammer immobile, and wherein rotation of the sear is controlled by rotating movement of the hammer.

10. A mechanism according to claim 1, further comprising a spring blade that is cooperable with said sear to stabilize said sear.

11. A mechanism according to claim 1, further comprising a bar that couples said trigger and said sear.

12. A mechanism according to claim 11, wherein said sear is rotatably mounted on said bar.

13. A mechanism for an automatic weapon, comprising:

a trigger;

a sear that moves between a starting position and a firing control position as said trigger is actuated;

a hammer, coupleable with said sear, said hammer being rotatable between a cocked position and a firing position during firing of said weapon; and means for positively locking said sear to said hammer as the hammer moves from an intermediate position toward the cocked position, wherein said means for positively locking includes means for translating the sear to the firing control position to cause the hammer to rotate toward the cocked position, and for rotating the sear from a low position to a high position after the hammer reaches the cocked position.

14. A mechanism according to claim 13, wherein said means for positively locking also causes the sear, after said firing of said weapon, to translate toward the starting position and to rotate from the high position to the low position to render the hammer immobile, rotation of the sear being controlled by rotating movement of the hammer.

15. A mechanism according to claim 13, wherein said means for positively locking includes a hooking element mounted on said sear that is cooperable with a bearing surface of said hammer.

16. The mechanism according to claim 15, wherein said means for positively locking further comprises a spring blade that stabilizes said sear during movement.

17. A functioning mechanism for an automatic weapon comprising:

a trigger;

a sear that moves between a starting position and a firing control position as said trigger is actuated, said sear including a hooking element;

a hammer rotatable between a cocked position and a firing position during firing of said weapon, said hammer including a bearing surface that is adapted to selectively contact the hooking element of the sear;

means for allowing the sear to exert a rearward axial force on the hammer to cause the hammer to rotate towards a cocked position when the sear moves to the firing control position; and means for rotating the sear from a low position to a high position after the hammer reaches the cocked position.

* * * * *